United States Patent [19]

Rehman

[11] 4,378,386

[45] Mar. 29, 1983

[54] METHOD OF SPRAYING CLOSED END CANS

[75] Inventor: William R. Rehman, Vermilion, Ohio

[73] Assignee: Nordson Corporation, Amherst, Ohio

[21] Appl. No.: 319,587

[22] Filed: Nov. 9, 1981

[51] Int. Cl.[3] ..... B05D 13/06; B05D 1/02; B05D 7/22

[52] U.S. Cl. ..... 427/233; 118/314; 118/315

[58] Field of Search ..... 427/233; 118/314, 315

[56] References Cited

U.S. PATENT DOCUMENTS 3,697,313 10/1972 Stumphauzer et al. .

3,843,055 10/1974 Nord et al. .

4,186,225 1/1980 Smith et al. ..... 427/233

*Primary Examiner*—James R. Hoffman

*Attorney, Agent, or Firm*—Wood, Herron & Evans

[57] ABSTRACT

Method and apparatus for coating the interior and bottom surfaces of food and beverage cans which require protection against contact with the food or beverage content of the cans. The interior surface is sprayed with a high solids content liquid spray emitted from a pair of nozzles, one of which sprays the lower portion of the cylindrical side wall as well as the outer portion of the bottom wall and the other of which sprays the top portion of the cylindrical wall and the innermost center section of the bottom wall.

14 Claims, 7 Drawing Figures

| CAN NBR. | 1 | 2 | 3 | 4 |
|---|---|---|---|---|
| SUBSTRATE MAT'L. | AL | " | " | " |
| NOZZLE | 21 | " | " | " |
| β, degrees | 40 | " | " | " |
| α, degrees | 25 | " | " | " |
| ORIFICE, inches | .008x .008 | " | " | " |
| FLOW RATE, gram/min. | 42.1 | " | " | " |
| RESTRICTOR, inches | .018 | " | " | " |
| DEGREES | 7 | " | " | " |
| $d_1$, mm mm | 15 | " | " | " |
| $d_2$, mm mm | 12 | " | " | " |
| DURATION, m sec. | 30 | 20 | 15 | 15 |

| NOZZLE | 20 | " | " | " |
|---|---|---|---|---|
| β, degrees | 50 | " | " | " |
| α, degrees | 50 | " | " | " |
| ORIFICE, inches | .004 x.006 | " | " | " |
| FLOW RATE, gram/min. | 15.6 | " | " | " |
| RESTRICTOR | ON | " | " | " |
| DEGREES | 4 | " | " | " |
| $d_3$, mm mm | 18 | " | " | " |
| $d_4$, mm mm | 13 | " | " | " |
| DURATION, m sec. | 150 | 150 | 150 | 100 |
| TEMPERATURE, °F | 185 | " | " | " |
| PRESSURE, LBS/SQ.IN. | 850 | " | " | " |
| RPM | 1950 | " | " | " |
| mg | 156 | 128 | 111 | 95 |
| WACO - mo | 3 | 2 | 5 | 10-15 |

Fig. 7

METHOD OF SPRAYING CLOSED END CANS

This invention relates to method and apparatus for coating the interior of metal cans, and more particularly, to an improved method and apparatus for applying a uniform coating to the interior surface of a cylindrical can body having only one open end.

Various methods have been proposed for coating the interior of metal cans used to contain food and beverages so as to protect the food and beverage from contact with the metal can surfaces. These methods and apparatus all function to completely coat the interior surface of a can body with a liquid lacquer or other protective material which when cured functions to completely cover that metal surface with an impervious coating.

In conventional practice, metal cans are made in either two pieces or in three pieces. A two piece can is made by deep drawing a cylinder with a closed end and then closing the cylinder with a can end. Three piece cans so-called comprise open ended cylindrical shell bodies to which separate top and bottom ends are secured. The invention of this application is concerned only with coating of two piece cans, i.e., those which are made from a deep drawn cylinder having a closed end.

Among the techniques which have been successfully employed to coat two piece cans, one technique is disclosed in U.S. Pat. No. 3,697,313 of Stumphauser, et al, assigned to the assignee of this application. Another technique is disclosed in U.S. Pat. No. 3,843,055 of Nord, et al, also assigned to the assignee of this application. Both of these patent techniques involve spraying the interior of the can through the open end with a liquid spray directed at an angle in excess of 14° at the can end through a so-called "drum head" nozzle or "controlled pattern" nozzle. Both of these nozzles are operative to emit a fan spray pattern with the majority of the liquid spray skewed heavily toward one end of the pattern. This nozzle is oriented with respect to the can so that the maximum flow of coating material is directed axially the length of the can and the fan shaped pattern is directed toward the radius of the can bottom and one longitudinal line on the side wall. This procedure results in a substantially uniform coating being applied over the side wall of the can; the distribution of the spray fan compensating for the increased distance the paint has to travel from the open to the closed end of the can.

The liquid sprays which have been found to be suitable for coating the interior of can bodies using either the "drum head" or "controlled pattern" nozzle techniques described in the above identified patents, are so-called "low solids" coating material. Low solids coating materials are defined as those which contain generally 15%-25% of solids relative to liquid solvent carriers. When the coating is cured only 15%-25% of the original weight of coating material remains after the solvents are driven off.

Recently there has been interest expressed in developing a coating technique which will enable "higher solids" or "high solids" to be satisfactorily applied to two piece can bodies. "Higher solids" are defined as coating materials which contain from approximately 25% to 65% of solid materials and the remainder solvents. "High solids" are coating materials which contain 65% or greater solids material and the remainder solvents. Until this invention though no one had been able to devise a spray method of apparatus which would enable either higher solids or high solids materials to be satisfactorily sprayed onto a two piece can interior.

Accordingly, it has been a primary objective of this invention to provide a method and apparatus for satisfactorily spraying high solids coating material onto the interior of two piece can bodies.

Many two piece can bodies have a bottom structure which consists of a depression or recess in the bottom of the can at the outer edge of the bottom and a high crowned center section interconnected by a so-called reverse wall section. Two piece cans having this type of bottom structure have always been difficult to completely coat on the interior surface because of the difficulty of applying and maintaining an adequate coating of material over the reverse wall section of the can body. When the can body is coated with a low solids type of coating material it has been found that the reverse wall section is generally substantially coated by material bounced or rebounded off of the lower cylindrical section of the can body. However, when high solids materials are applied to the cans of this configuration it has been found that this rebound or bounce either does not occur or occurs to a lesser degree with the result that it is extremely difficult to obtain satisfactory coating of the reverse wall section of the can. Otherwise expressed, nozzles and processes which have heretofore been satisfactory for the application of low solids coating materials do not apply a satisfactory quantity of material to the reverse wall section of the bottom of this type of can, with the result that such conventional equipment and set-ups cannot be employed for high solids or even higher solids coating applications.

This invention is predicated in part upon the discovery that high solids or higher solids liquid coating materials may be satisfactorily applied to two piece can bodies by utilizing two nozzles to apply the coating material. One of these nozzles is operative to spray the lower portion of the cylindrical side wall of the can body as well as the reverse wall section of the bottom of the can body while the other nozzle sprays the top portion of the side wall and the crown or center section of the bottom wall. This spray pattern reduces the need to bounce spray off of the lower cylindrical section of the body in order to adequately coat the reverse wall section and enables that section to be coated with a minimum of material.

Furthermore, this spray technique and/or process has been found to result in a much more uniform coating of the interior of the can body than has heretofore been possible with even low solids material. Specifically, this invention enables the spray material to be applied more evenly to the can body than has heretofore been possible. As a result, a lesser total quantity of material may be used to effect complete coverage of the inside surface of the can since it is no longer necessary to apply excess material to some areas of the can body in order to obtain minimum coverage of selected hard to get at areas.

These and other objects and advantages of this invention will be more readily apparent from the following description of the drawings in which:

FIG. 7 is a chart of conditions employed in the practice of this invention.

Figure 1:
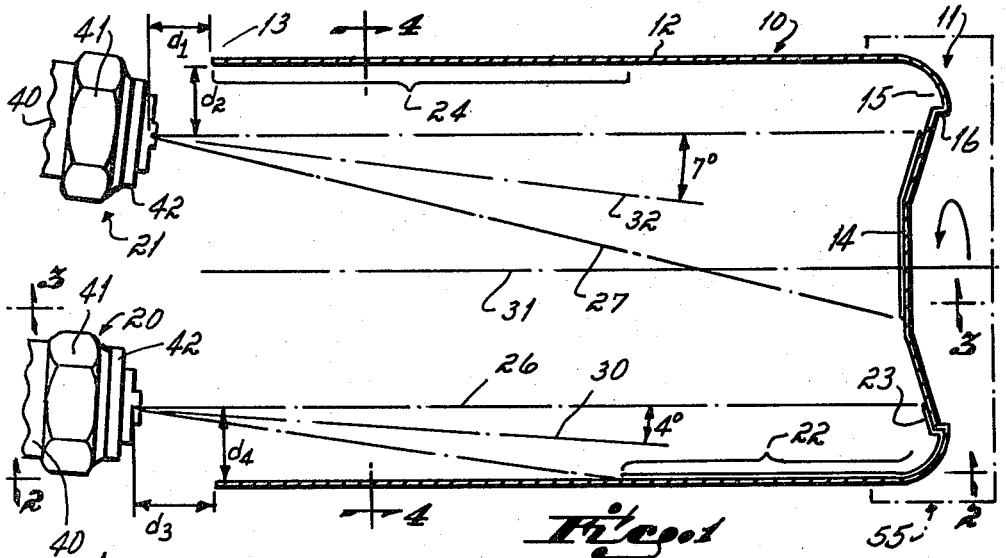
FIG. 1 is a cross sectional view through a can illustrating the novel method and apparatus of this invention for spraying the interior of the can.
Figure 2:
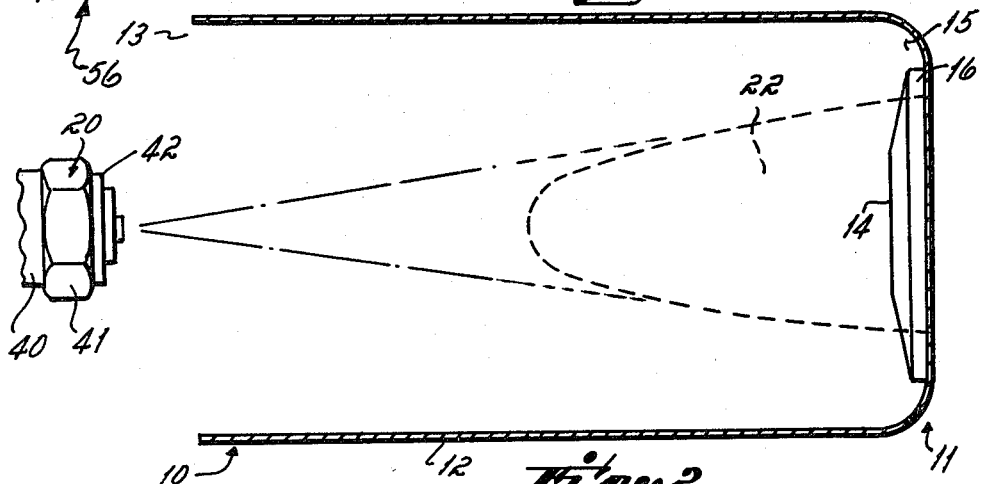
FIG. 2 is a cross sectional view taken on line 2—2 of FIG. 1.
Figure 3:
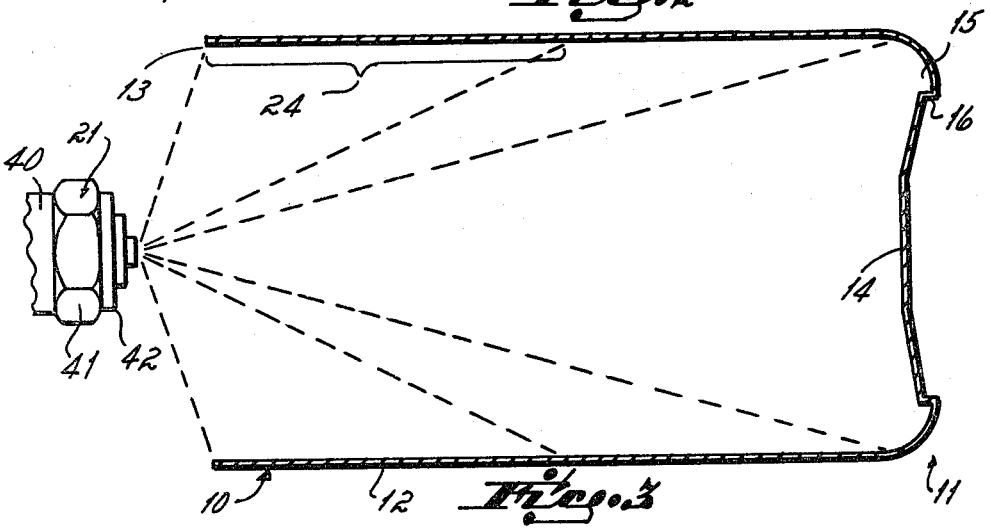
FIG. 3 is a cross sectional view taken on line 3—3 of FIG. 1.

Referring first to FIGS. 1–3 there is illustrated a two piece can 10 of the type which is coated by the practice of this invention. It is referred to as a two piece can because it is drawn from a single blank of metal which forms the bottom wall 11 and side wall 12 from a single piece of metal. The second piece in this type of two piece can is a can end which is applied to the open end 13 after the can has been coated according to the practice of the invention and has been filled with food or beverage contents.

The can body 10 comprises the cylindrical side wall 12 and a bottom crown section 14. These two sections 12 and 14 are interconnected by a radiused well section 15 and a reverse wall section 16. The reverse wall section 16 generally extends parallel to the side wall 12 and is the section of can body which is particularly difficult to coat utilizing can coating techniques of the type commonly in use prior to the invention of this application.

With reference to FIG. 1 it will be seen that there are two airless spray nozzles 20, 21 directed through the open top 13 of the can. One of these nozzles 20 is operative to spray the inner section 22 of the side wall 12, the well section 15 of the bottom wall, the reverse wall section 16 of the bottom wall, and a very small portion 23 of the crown section 14 of the bottom wall. The other nozzle 21 is operative to spray the crown section 14 of the bottom wall and the outermost portion 24 of the side wall. As may be seen most clearly in FIG. 3, the nozzle 21 also is operative to spray to a lesser extent the inner portion 22 of the side wall as well as the well section and reverse wall section of the bottom 14. The heaviest portion of the spray from the nozzle 21 though is directed at the outer portion 24 of the side wall 12 and the crown section 14 of the bottom wall.

Figure 4:
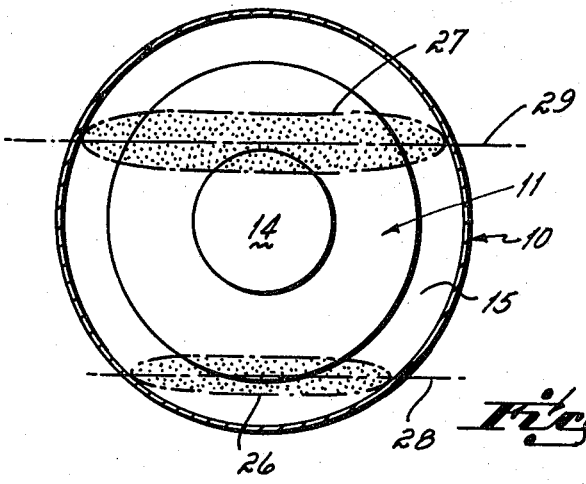
FIG. 4 is a cross sectional view taken on line 4—4 of FIG. 1.

With reference to FIG. 4 it will be seen that the fan shaped spray patterns 26 and 27 from the nozzles 20 and 21 respectively are located on cordal planes 28, 29 of the can body rather than diametral planes as has heretofore been common practice in the coating of two piece cans. It will also be noted that these two cordal planes extend parallel to one another so that the two spray patterns emitted from the nozzles 20, 21 even though sprayed simultaneously do not impinge upon one another.

With reference to FIG. 1 it will be seen that the center line 30 of the spray pattern 26 extends at a 4° angle relative to the center line 31 of the can body 10. It will also be noted that the center line 32 of the spray pattern 27 emitted from the nozzle 21 extends at a 7° angle to the center line 31 of the can body.

Figure 5:
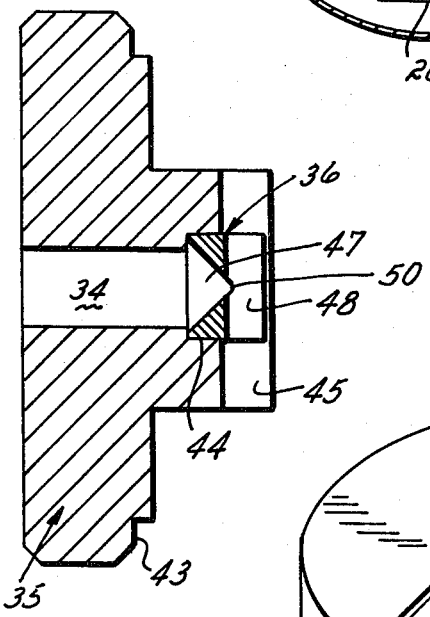
FIG. 5 is a cross sectional view through the nozzle tip and nozzle holder of one of the nozzles of FIG. 1.
Figure 6:
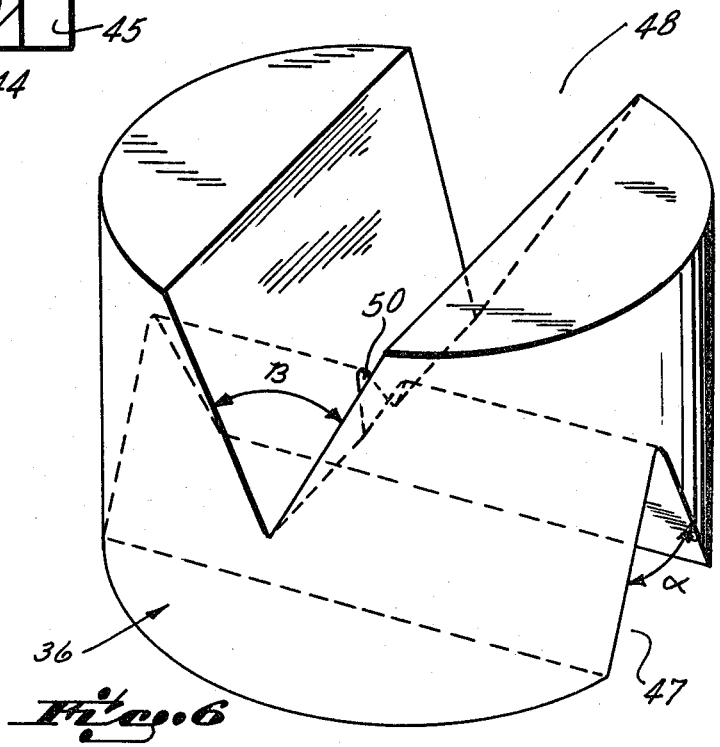
FIG. 6 is a perspective view of a nozzle tip employed in the nozzles of FIG. 1.

Referring now to FIGS. 5 and 6 there is illustrated a nozzle holder 35 and a nozzle tip 36 employed in the practice of this invention. Since the nozzle holder and nozzle tip 35 and 36 are substantially identical in the nozzles 20 and 21 except for dimensional differences as described more fully hereinafter, only one nozzle holder and nozzle tip will be described in detail herein. It should be appreciated though that a substantially identical nozzle holder and nozzle tip differing only in dimensions are employed in the other nozzle.

The nozzle holder 35 is secured onto the outlet end 40 of a conventional dispensing gun by a threaded nut 41. This nut 41 has a collar 42 which engages a shoulder 43 of the holder 35 and secures it to the outer end 40 of the gun in a sealed relationship.

Extending through the nozzle holder 35 there is an axial bore 34. This bore is counterbored as illustrated at 44 for the reception of the nozzle tip 36. Additionally, a transverse groove 45 is cut through the outer end of the nozzle holder so as to prevent the outer end from interfering with spray emitted from the nozzle tip 36.

The nozzle tip 36 is manufactured from a very small slug of sintered metal or sintered carbide. This sintered slug is cross cut by two intersecting slots 47, 48, the first slot 47 is located on the back side of the tip and the other slot 48 is located on the front side of the tip. The two slots are offset from one another by 90°. Each slot extends approximately one-half the thickness of the slug but at least one of the two is sufficiently deep that it intersects the other slot. Both slots are cut by a grinding wheel having a V-shaped peripheral edge. In the case of the nozzle 21 the back side groove 47 of the tip 36 within that nozzle is cut by a grinding wheel defining an included angle of 40° with the result that the slot 47 also defines an included angle $\alpha$ of 40°. The front slot of nozzle tip 36 in the nozzle 21 is cut with a grinding wheel defining an included angle $\beta$ of 25°. The intersection of the two intersecting grooves define an orifice 50 which is 0.008" wide and 0.008" long, and this nozzle has a flow rate of 42.1 grams per minute of water at 40 pounds per square inch gauge.

The other nozzle tip 36 contained within the nozzle 20 has a back side groove defining an included angle $\alpha$ of 50° and a front side groove which also defines an included angle $\beta$ of 50°. The grooves of this nozzle 21 are cut to a depth such that the orifice 50 of the nozzle tip is 0.004" wide by 0.006" long. This nozzle has a flow rate of 15.6 grams per minute of water at 40 psig.

A more complete description of the cross cut nozzle 36 and the manner in which this nozzle is manufactured may be found in pending application Ser. No. 706,361, filed July 19, 1976 and assigned to the assignee of this application, now U.S. Pat. No. 4,346,849.

In practice, the can body 10 is mounted upon a conventional can coating machine having multiple rotatable heads 55 for the reception of the can bodies. These heads 55 are indexable through multiple stations and at one station 56 align the can bodies 10 in front of the nozzles 20, 21 as illustrated in FIGS. 1–3. At this station 56 the axis 31 of the can body is located in a horizontal plane and the can is rotated by the head 55 at a preset speed. During this rotation of the can body 10 at the coating station 56, liquid supplied to the dispensing gun 40, 41 at a relatively high pressure, is ejected from the nozzles 20, 21 for a predetermined short duration of time. This high pressure liquid emerges from the nozzle tip as an atomized spray in the patterns 26, 27 described hereinabove. After the expiration of the predetermined period of spray time, a valve internally of the gun 40, 41 is closed and liquid spray from the nozzles is terminated. The can supporting heads 55 are then indexed and a new uncoated can moved before the fixedly mounted nozzles as is conventional in such can coating machines.

Conditions under which four conventional cans were coated according to the practice of this invention are set forth in the chart of FIG. 7. With reference to this chart it will be seen that the cans, which were conventional 2⅝ inch diameter aluminum cans, were sprayed by two nozzles 20, 21 in each test. With reference to test can No. 1 it will be noted that the nozzle 21 was used in combination with a restrictor having an internal orifice 0.018" in diameter. Such restrictors are commonly used in the airless spraying of cans and are well known in the trade. The nozzle 21 was set at an angle of 7° relative to the longitudinal axis of the can body as illustrated in FIG. 1. The nozzle orifice was placed a distance $d_1$ of 15 millimeters from the open end of the can body 10 and a distance $d_2$ of 12 millimeters from the side wall of the can. The can body was sprayed by this nozzle for 30 milliseconds while the can body was rotated at 1950 RPM. This time represents approximately one full revolution of the can body. The other nozzle 20 was placed 18 millimeters from one side wall of the can. This nozzle applied spray to the can body for 150 milliseconds during this test. The liquid sprayed from both nozzles during this test was formulated as follows:

| | |
|---|---|
| Epoxy Ester | |
| Shell Chemical (CLR-400) | 1515.5 g. |
| Hexamethoxymethylmelamine | |
| American Cyanamide (Cymel 303) | 910.0 g. |
| Acrylic Copolymer | |
| Monsanto (Modaflow) | 11.4 g. |
| 31.7% Citric Acid in Isopropanol | 108.2 g. |
| N—Butanol | 568.9 g. |
| Butyl Cellosolve | 454.8 g. |
| | 3568.8 g. |
| Wgt/gal. | 8.46 lbs. |
| Viscosity (ICI Cone & Plate | 200 cps at 25° C. |
| #Cone) | 60 cps at 50° C. |
| Solids (Non-Volatile) 2 hrs. | |
| at 225° C. | 65% |

This liquid was supplied to the nozzles at 185° F. at a pressure of 850 pounds per square inch gauge. The results of this test were that 156 milligrams of dry coating material were applied to the interior of the can. This is the weight of the sprayed material after the can had been removed from the coating machine and the solvents driven out of the sprayed material. This dry coating represented 65% of the weight of the coating when measured on the can wet, meaning that the coating was 65% solids in the wet condition. When tested with a Waco tester, this can measured 2 to 3 milliamps of current passing between a probe inserted into a salt water solution contained within the can and a contact attached to the exterior of the can body 10. Anything under 30 milliamps is considered satisfactory and to indicate that there are no pin holes, cracks or imperfections in the coating on the interior of the can body.

In the second test can No. 2 the conditions were the same as for the first test can No. 1 except that the spraying times were varied. As a result only 128 milligrams of cured coating material was applied to the can. This can, when tested with a conventional Waco tester, was found to measure only two milliamps.

In the third and fourth tests, the conditions were again the same as with can No. 1 except that the spray cycles were again varied. In these tests 111 milligrams of coating material were applied to the third can and in a fourth test 95 milligrams were applied. The third can tested 5 milliamps of current transmitted through the can coating and the fourth can transmitted between 10 and 15 milliamps. All four cans though were perfectly satisfactory and well under the 30 milliamp standard.

Prior to this invention it has been common to measure the thicknesses of material over the surface area of the can. In general, substantially greater thicknesses of coating have been found to have been applied to the can side walls than was required in order to obtain minimum coverage of the reverse wall 16 section of the can bottom. According to the practice of this invention though, and as evidenced by the four tests described in the chart, the can coating is very even, and even though it is substantially reduced from the first to the fourth test there is very little difference in the amount of current passed through the can coating. Furthermore, the practice of this invention for the first time enables a high solids content liquid to be utilized in the interior surface of a two piece can. Prior to this invention, and to our knowledge, no one had ever before satisfactorily sprayed a two piece can interior with a liquid having greater than 25% solids content. The four tests described in the chart though utilized a liquid which contains 65% solids. As a result, substantially less solvent had to be driven from the sprayed material in order to cure it. This has the advantage of minimizing environmental pollutants as well as minimizing the cost of solvent required to be wasted in the coating of the can body. Because there is less solvent to drive off of the can less heat and energy is required to drive it off, and of course the can coating cure cycle may be shortened.

While I have described only a single preferred embodiment of the invention and four test conditions under which the invention was practiced, persons skilled in this art will appreciate changes and modifications which may be made without departing from the spirit of my invention. For example, simultaneous operation of the two nozzles has been described but sequential operation of the nozzles in different physical locations to coat the same rotating can is a variant which will readily be apparent as an alternative. Therefore, I do not intend to be limited except by the scope of the following appended claims:

I claim:

1. The method of spraying liquid spray onto the interior surface of a two-piece can body so as to completely coat the interior surface of said can body, said can body having a side wall, a bottom wall and an open top, which method comprises, rotating said can, spraying through the open top a lower portion of said side wall and the outer portion of said bottom wall of said rotating can with a first nozzle, and spraying through the open top at least the top portion of said side wall and the inner portion of said bottom wall of said rotating can with a second nozzle.

2. The method of spraying liquid spray onto the interior surface of a two-piece can body so as to completely coat the interior surface of said can body, said can body being of the type having a side wall and a bottom wall comprising a bottom well section, a bottom reverse wall section and a bottom crown section, which method comprises, rotating said can, spraying a lower portion of said side wall section and said bottom well section and said bottom reverse wall section of said rotating can with a first nozzle, and spraying at least the top portion of said side wall and said bottom crown section of said rotating can with a second nozzle.

3. The method of claim 2 in which the center line of the spray pattern of both of said nozzles is angled at an angle of less than 14° relative to the axial center line of said can during said spraying process.

4. The method of claim 2 in which the center line of the spray pattern of said first nozzle is angled at an angle of less than 14° relative to the axial center line of said can during said spraying process.

5. The method of claim 2 in which the center line of the spray pattern of said second nozzle is angled at an angle of less than 14° relative to the axial center line of said can during said spraying process.

6. The method of claim 2 in which the center line of the spray pattern of said first nozzle is angled at an angle of approximately 4° relative to the axial center line of said can during said spraying process and the center line of the spray pattern of said second nozzle is angled at an angle of approximately 7° relative to the axial center line of said can during said spraying process.

7. The method of spraying liquid spray having a solids content in excess of twenty-five percent of the sprayed material onto the interior surface of a two-piece can body so as to completely coat the interior surface of said can body, said can body being of the type having a side wall and a bottom wall comprising a bottom well section, a bottom reverse wall section, and a bottom crown section, which method comprises, rotating said can, spraying a lower portion of said side wall section, said bottom well section and said bottom reverse wall section of said rotating can with a first fan spray nozzle, and spraying at least the top portion of said side wall and said bottom crown section of said rotating can with a second spray nozzle.

8. Apparatus for spraying liquid spray onto the interior surface of a two piece can body so as to completely coat the interior surface of said can body, said can body being of the type having a side wall and a bottom wall comprising a bottom well section, a bottom reverse wall section and a bottom crown section, which apparatus comprises, means for rotating said can, means including a first nozzle for spraying a lower portion of said side wall section, said bottom well section and said bottom reverse wall section of said rotating can, and means including a second nozzle for spraying at least the top portion of said side wall and said bottom crown section of said rotating can.

9. The apparatus of claim 8 in which the center line of the spray pattern of both of said nozzles is angled at an angle of less than 14° relative to the axial center line of said can during said spraying.

10. The apparatus of claim 8 in which the center line of the spray pattern of said first nozzle is angled at an angle of less than 14° relative to the axial center line of said can during said spraying.

11. The apparatus of claim 8 in which the center line of the spray pattern of said second nozzle is angled at an angle of less than 14° relative to the axial center line of said can during said spraying.

12. The apparatus of claim 8 in which the center line of the spray pattern of said first nozzle is angled at an angle of approximately 4° relative to the axial center line of said can during said spraying and the center line of the spray pattern of said second nozzle is angled at an angle of approximately 7° relative to the axial center line of said can during said spraying.

13. Apparatus for spraying liquid spray having a solids content in excess of twenty-five percent of the sprayed material onto the interior surface of a two piece can body so as to completely coat the interior surface of said can body, said can body being of the type having a side wall and a bottom wall comprising a bottom well section, a bottom reverse wall section, and a bottom crown section, which apparatus comprises, means for rotating said can, means including a first fan spray nozzle for spraying a lower portion of said side wall section, said bottom well section and said bottom reverse wall section of said rotating can from said first nozzle, and means including a second fan spray nozzle for spraying at least the top portion of said side wall and said bottom crown section of said rotating can from said second nozzle.

14. Apparatus for spraying liquid spray onto the interior surface of a two-piece can body so as to completely coat the interior surface of said can body, said can body having a side wall, a bottom wall and an open top, which apparatus comprises, first and second nozzles, means for rotating said can, means for spraying through the open top a lower portion of said side wall and the outer portion of said bottom wall of said rotating can with said first nozzle, and means for spraying through the open top at least the top portion of said side wall and the inner portion of said bottom wall of said rotating can with said second nozzle.

* * * * *

UNITED STATES PATENT AND TRADEMARK OFFICE

CERTIFICATE OF CORRECTION

PATENT NO. : 4,378,386

DATED : March 29, 1983

INVENTOR(S) : William R. Rehman

It is certified that error appears in the above-identified patent and that said Letters Patent is hereby corrected as shown below:

Column 5, line 34, "#Cone" should be -- #10 Cone --

Signed and Sealed this

*Twentieth* Day of *September 1983*

[SEAL]

*Attest:*

GERALD J. MOSSINGHOFF

*Attesting Officer*

*Commissioner of Patents and Trademarks*